US012338580B2

(12) United States Patent
Uil

(10) Patent No.: US 12,338,580 B2
(45) Date of Patent: Jun. 24, 2025

(54) PROCESS FOR PRODUCING COLOURED CARDBOARD IN A CARDBOARD PRODUCTION APPARATUS, AND COLOURED PRODUCED BY SUCH A PROCESS

(71) Applicant: Eska B.V., Sappemeer (NL)

(72) Inventor: Albertus Uil, Wildervank (NL)

(73) Assignee: Eska B.V., Sappemeer (NL)

( * ) Notice: Subject to any disclaimer, the term of this patent is extended or adjusted under 35 U.S.C. 154(b) by 355 days.

(21) Appl. No.: 17/912,297

(22) PCT Filed: Feb. 3, 2021

(86) PCT No.: PCT/NL2021/050065
§ 371 (c)(1),
(2) Date: Sep. 16, 2022

(87) PCT Pub. No.: WO2021/201671
PCT Pub. Date: Oct. 7, 2021

(65) Prior Publication Data

US 2023/0141227 A1 May 11, 2023

(30) Foreign Application Priority Data

Mar. 31, 2020 (NL) ..... 2025251

(51) Int. Cl.
*D21H 23/04* (2006.01)
*D21H 17/65* (2006.01)
*D21H 21/28* (2006.01)

(52) U.S. Cl.
CPC ..... *D21H 23/04* (2013.01); *D21H 17/65* (2013.01); *D21H 21/28* (2013.01)

(58) Field of Classification Search
CPC ..... D21H 23/04; D21H 17/65; D21H 21/28; D21H 27/10; D21H 23/06
See application file for complete search history.

(56) References Cited

U.S. PATENT DOCUMENTS 1,518,371 A * 12/1924 Traquair ..... D21H 19/44 427/365
2,228,465 A * 1/1941 Laughlin ..... D21H 21/28 162/162

(Continued)

FOREIGN PATENT DOCUMENTS

CN 1078726 A 11/1993
CN 103703082 A 4/2014

(Continued)

OTHER PUBLICATIONS

Machine Translation of JP 2019-189950 A. (Year: 2019).*

(Continued)

*Primary Examiner* — Jose A Fortuna
(74) *Attorney, Agent, or Firm* — Banner & Witcoff, Ltd.

(57) ABSTRACT

According to the invention, in producing coloured cardboard, carbon dioxide is injected and dissolved in a mixture of pulp and at least a sulphur dye, while the mixture is pumped with a delivery pressure higher than 200 kPa out of a first pulp reservoir (11) towards a second pulp reservoir (12), and in such manner that the mixture is acidified by the carbon dioxide to become an acidified coloured pulp mixture (14) with a pH-value between 6.5 and 7.0. The acidified coloured pulp is injected under high pressure out of a pulp duct structure (7) into the second pulp reservoir (12) at a distance of at least 2 meter below a level (15) of the acidified coloured pulp mixture (14) in the second pulp reservoir (12). Accordingly, the invention provides a high-quality colouring of cardboard, wherein environmental problems are prevented.

1 Claim, 1 Drawing Sheet

(56) References Cited

U.S. PATENT DOCUMENTS

| | | | | | |
|---|---|---|---|---|---|
| 2,370,344 | A * | 2/1945 | Fisher | D21H 21/28 | 8/919 |
| 2,419,207 | A * | 4/1947 | Fisher | D21H 19/828 | 427/365 |
| 2,515,340 | A * | 7/1950 | Fisher | D21J 1/08 | 427/303 |
| 5,302,441 | A | 4/1994 | Canary | | |
| 5,611,818 | A | 3/1997 | Domingo | | |
| 6,117,491 | A * | 9/2000 | Rutanen | D21H 23/30 | 427/364 |
| 6,190,735 | B1 * | 2/2001 | Radwanski | D21H 25/005 | 427/353 |
| 8,241,454 | B2 * | 8/2012 | Kraus | B31F 1/2822 | 156/207 |
| 2004/0110883 | A1 * | 6/2004 | Pakan | D21H 21/28 | 524/451 |
| 2007/0012412 | A1 * | 1/2007 | Goodrow | D21H 27/26 | 162/123 |
| 2010/0126683 | A1 | 5/2010 | Chopra | | |
| 2010/0311296 | A1 * | 12/2010 | Boehmer | D21H 21/28 | 427/370 |
| 2023/0084783 | A1 * | 3/2023 | Uil | D21F 11/04 | 162/201 |
| 2023/0141227 | A1 * | 5/2023 | Uil | D21H 27/10 | 162/162 |
| 2023/0313465 | A1 * | 10/2023 | Hiltunen | D21H 21/28 | 162/135 |

FOREIGN PATENT DOCUMENTS

| | | | | |
|---|---|---|---|---|
| CN | 108867116 | A | 11/2018 | |
| DE | 602004006276 | T2 * | 12/2007 | A62D 1/00 |
| EP | 0281273 | A1 | 9/1988 | |
| ES | 2966482 | T3 * | 4/2024 | D21H 17/65 |
| JP | 2011021283 | A * | 2/2011 | |
| JP | 2019189950 | A * | 10/2019 | D21H 17/65 |
| WO | WO-2022058655 | A1 * | 3/2022 | D21H 17/23 |

OTHER PUBLICATIONS

Machine Translation of JP 2011-021283 (Year: 2011).*

International Search Report and Written Opinion—PCT/NL2021/050065—mailing date Jul. 10, 2021.

* cited by examiner

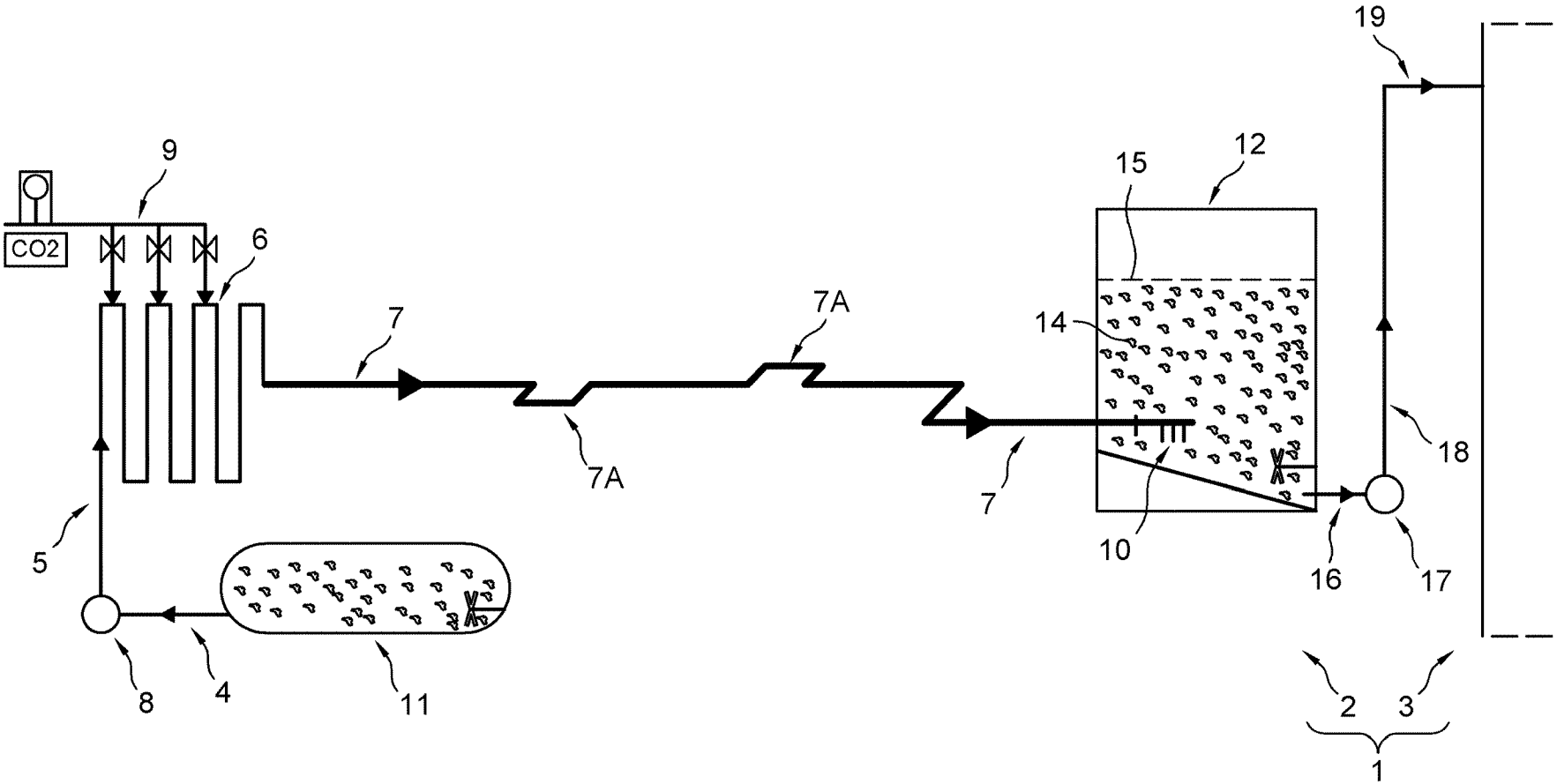
CO2
9
6
7
7A
7A
7
5
8
4
11
14
15
12
10
16
17
18
19
2
3
1

PROCESS FOR PRODUCING COLOURED CARDBOARD IN A CARDBOARD PRODUCTION APPARATUS, AND COLOURED PRODUCED BY SUCH A PROCESS

CROSS-REFERENCE TO RELATED APPLICATIONS

This application is a U.S. National Stage application under 35 U.S.C. § 371 of International Application PCT/NL2021/050065 (published as WO 2021/201671 A1), filed Feb. 3, 2021 which claims the benefit of priority to Application NL 2025251, filed Mar. 31, 2020. Benefit of the filing date of these prior applications is hereby claimed. Each of these prior applications is hereby incorporated by reference in its entirety.

FIELD OF THE INVENTION

The invention relates to a process for producing coloured cardboard in a cardboard production apparatus, wherein the cardboard production apparatus comprises a pulp colouring apparatus for colouring a pulp with at least a sulphur dye. The invention further relates to coloured cardboard produced by such a process.

BACKGROUND OF THE INVENTION

It is known to colour pulp, which is used in producing cardboard, with sulphur dyes. Sulphur dyes provide high-quality colouring of cardboard and have certain advantages in producing cardboard. After all, sulphur dyes applied in cardboard do not discolour, do not bleed, provide practically colourless flowback water and having a low cost price.

Due to adding a sulphur dye to the pulp, the pH-value of the pulp increases (typically to pH=10 to 11 as an order of magnitude). During the production process this high pH-value needs to be decreased (to pH=6.5 to 7.0), because otherwise the dye would not precipitate in the right form on and in the fibers of the pulp.

In producing coloured cardboard it is known to acidify the pulp, to which a sulphur dye has been added, with hydrochloric acid, alum or acetic acid. However, this kind of acidification causes substantial environmental problems. For, in acidification with hydrochloric acid (a strong acid), at the location of an injected jet of hydrochloric acid there is released very much $H_2S$, which is a toxic and explosive chemical. And acidification with alum or acetic acid (weak acids) undesirably results into leaving behind of acid radicals in the waste water, which causes various problems and overloading in the waste water purification. Acidification with alum for example leads to an excess of sulphate in the effluent.

Because of these environmental problems, in producing coloured cardboard, with its open processes, sulphur dyes are used less and less.

SUMMARY OF THE INVENTION

It is an object of the invention to provide a solution for producing cardboard coloured with a sulphur dye, wherein the above-mentioned environmental problems are prevented.

For that purpose the invention provides a process, as well as coloured cardboard, as described herein.

Hence, the invention provides a process for producing coloured cardboard in a cardboard production apparatus, wherein the cardboard production apparatus comprises a pulp colouring apparatus for colouring a pulp with at least a sulphur dye, characterized in that:

the pulp colouring apparatus comprises a first pulp reservoir, a second pulp reservoir, a pulp duct structure, pulp pumping means, carbon dioxide injection means, and pulp injection means, and the process comprises:

mixing the pulp and at least a sulphur dye in the first pulp reservoir, pumping, by the pulp pumping means via the pulp duct structure, the pulp, and the sulphur dye mixed with the pulp, out of the first pulp reservoir towards the second pulp reservoir, wherein the pulp pumping means has a delivery pressure higher than 200 kPa, injecting, by the carbon dioxide injection means, carbon dioxide into the pulp duct structure, in such manner that in the pulp duct structure the carbon dioxide is mixed with the pulp and the sulphur dye mixed with the pulp which are being pumped out of the first pulp reservoir towards the second pulp reservoir, wherein a residence time of the carbon dioxide in the pulp duct structure is longer than 20 seconds, so that the pulp and the sulphur dye mixed with the pulp, by the carbon dioxide injected and dissolved therein, in the pulp duct structure is being acidified to become an acidified coloured pulp mixture having a pH-value between 6.5 and 7.0, injecting the acidified coloured pulp mixture, by the pulp injection means, out of the pulp duct structure into the second pulp reservoir, wherein, at the location of injecting the acidified coloured pulp mixture, the acidified coloured pulp mixture to be injected has a static pressure in the pulp duct structure which is higher than 150 kPa, and wherein said injecting the acidified coloured pulp mixture takes place at a distance of at least 2 meters below a level of the acidified coloured pulp mixture in the second pulp reservoir, pumping the acidified coloured pulp mixture out of the second pulp reservoir towards cardboard production parts of the cardboard production apparatus, and producing, by said cardboard production parts, coloured cardboard from the acidified coloured pulp mixture.

It appears that, thanks to thus applying carbon dioxide to the pulp and the sulphur dye mixed with the pulp, the sulphur dye precipitates in the right form on and in the fibers of the pulp, without the above-mentioned environmental problems that occur in the above-mentioned known manners of acidification of pulp to which a sulphur dye is added.

This is explained as follows. Carbon dioxide is one of the weakest acids. The pKa-value of carbon dioxide is 6.3 as an order of magnitude, whereby the pH-value of the acidified coloured pulp mixture does not easily get below 6.8. Because of that, the equilibrium $H_2 \leftrightarrow HS^- \leftrightarrow S^-$ stays as much as possible away from the undesirable $H_2S$ form. In addition, according to the invention the carbon dioxide is applied under pressure, whereby relatively much carbon dioxide dissolves and the acidified coloured pulp mixture acquires a pH-value lying between 6.5 and 7.0, and in preferable embodiments lying between 6.6 en 6.8. Hereby the sulphur dye precipitates in the right form on and in the fibers of the pulp, whereby an excellent colouring result is obtained. The 'under pressure' application has the additional advantage that the $H_2S$ remainder stays dissolved. At pressure release, the pH-value increases again, whereby the $H_2S$ remainder converts again in $HS^-$. The acid radical is $HCO_3^-$, which is not environmentally troublesome.

BRIEF DESCRIPTION OF THE DRAWINGS

In the following the invention is further elucidated with reference to a non-limiting embodiment, with reference to the schematical FIG. 1 in the appended drawing.

FIG. 1 schematically shows in side-view an example of a pulp colouring apparatus during the execution of an example of an embodiment of a process according to the invention for producing coloured cardboard in a cardboard production apparatus.

DETAILED DESCRIPTION OF THE INVENTION

The cardboard production apparatus 1 of FIG. 1 comprises the pulp colouring apparatus 2 and the cardboard production parts 3. These cardboard production parts 3 are depicted in FIG. 1 only highly schematically.

In the shown example the first pulp reservoir 11 of the pulp colouring apparatus 2 is a mixing tank having therein a mixture of paper pulp, with a fiber concentration of more than 2%, and a sulphur dye. In this example the sulphur dye is black sulphur. The pH-value of the mixture in this mixing tank lies between 10 and 11. The pulp duct structure comprises ducts 4 and 5, in which the pump 8 is placed with a working head. The pulp duct structure further comprises a curvy duct 6. The duct 6 is relatively thin (DN150) in order to obtain a relatively high velocity of the pulp mixture being pumped therein.

The carbon dioxide injection means 9 is connected to the duct 6, that is to say relatively shortly after the pump 8, where the pressure is relatively high and where the velocity of the pulp mixture is higher than 2.5 m/sec. This promotes turbulence, which is favourable for good mixing.

Downstream of the duct 6 the pulp duct structure further comprises a duct 7, which is relatively long and relatively thick (DN250) for obtaining a long residence time of the pulp mixture being acidified in the duct 7. In the shown example the duct 7 comprises curvy sections 7A to improve the mixing action.

At its downstream end the duct 7 is connected to the pulp injection means 10 in the form of the shown nozzle structure 10. Via this nozzle structure 10 the acidified coloured pulp mixture 14 is injected out of the duct 7 into the second pulp reservoir 12. The second pulp reservoir 12 is a mixing reservoir in which the coloured pulp mixture 14 is further mixed.

The injection into the second pulp reservoir 12 takes place at a distance of at least 2 meter below the level 15 of the coloured pulp mixture 14 in the second pulp reservoir 12. Preferably this injection takes place as low as possible below in the second pulp reservoir 12. This injection as low as possible below in the second pulp reservoir 12 is important to keep the pressure drop along the nozzle structure 10 low, in order to thereby avoid excessive stripping of carbon dioxide from the vena contracta of the nozzle structure 10. For, excessive stripping of the carbon dioxide could disturb the pulp flow in the second pulp reservoir 12. Furthermore, the nozzle structure 10 does not have only one, but a plurality of exit flow openings, whereby the pulp flow is not or hardly blocked in case of stripping.

By the shown pump 17 the coloured pulp mixture 14 is pumped, via the shown ducts 16, 18 and 19, out of the second pulp reservoir 12 towards the cardboard production parts 3 of the cardboard production apparatus 1 for producing coloured cardboard.

Keeping the coloured pulp mixture 14 in the second pulp reservoir 12 at a sufficiently high level 15 can be realized via frequency control of the pump 17.

The invention claimed is:

1. A process for producing coloured cardboard in a cardboard production apparatus, wherein the cardboard production apparatus comprises a pulp colouring apparatus for colouring a pulp with at least a sulphur dye, wherein:

the pulp colouring apparatus comprises a first pulp reservoir, a second pulp reservoir, a pulp duct structure, pulp pumping means, carbon dioxide injection means, and pulp injection means, and the process comprises:

mixing the pulp and at least a sulphur dye in the first pulp reservoir, pumping, by the pulp pumping means via the pulp duct structure, the pulp, and the sulphur dye mixed with the pulp, out of the first pulp reservoir towards the second pulp reservoir, wherein the pulp pumping means has a delivery pressure higher than 200 kPa, injecting, by the carbon dioxide injection means, carbon dioxide into the pulp duct structure, in such manner that in the pulp duct structure the carbon dioxide is mixed with the pulp and the sulphur dye mixed with the pulp which are being pumped out of the first pulp reservoir towards the second pulp reservoir, wherein a residence time of the carbon dioxide in the pulp duct structure is longer than 20 seconds, so that the pulp and the sulphur dye mixed with the pulp, by the carbon dioxide injected and dissolved therein, in the pulp duct structure is being acidified to become an acidified coloured pulp mixture having a pH-value between 6.5 and 7.0, injecting the acidified coloured pulp mixture, by the pulp injection means, out of the pulp duct structure into the second pulp reservoir, wherein, at the location of injecting the acidified coloured pulp mixture, the acidified coloured pulp mixture to be injected has a static pressure in the pulp duct structure which is higher than 150 kPa, and wherein said injecting the acidified coloured pulp mixture takes place at a distance of at least 2 meters below a level of the acidified coloured pulp mixture in the second pulp reservoir, pumping the acidified coloured pulp mixture out of the second pulp reservoir towards cardboard production parts of the cardboard production apparatus, and producing, by said cardboard production parts, coloured cardboard from the acidified coloured pulp mixture.

* * * * *